US006747525B2

(12) United States Patent
Iida et al.

(10) Patent No.: US 6,747,525 B2
(45) Date of Patent: Jun. 8, 2004

(54) DIRECTIONAL COUPLER

(75) Inventors: Naoki Iida, Sagamihara (JP); Masahiko Kawaguchi, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/066,716

(22) Filed: Feb. 6, 2002

(65) Prior Publication Data

US 2002/0130733 A1 Sep. 19, 2002

(30) Foreign Application Priority Data

Mar. 16, 2001 (JP) ..... 2001-076191

(51) Int. Cl.[7] ..... H01P 5/18
(52) U.S. Cl. ..... 333/116; 333/109
(58) Field of Search ..... 333/10, 84, 116, 333/101, 109

(56) References Cited

U.S. PATENT DOCUMENTS 3,999,150 A * 12/1976 Caragliano et al. ..... 333/116
5,006,821 A * 4/1991 Tam ..... 333/116
5,994,985 A * 11/1999 Pehlke et al. ..... 334/14
6,472,950 B1 * 10/2002 London ..... 333/125
6,483,398 B2 * 11/2002 Nagamori et al. ..... 333/116

* cited by examiner

*Primary Examiner*—Patricia Nguyen
(74) *Attorney, Agent, or Firm*—Keating & Bennett, LLP

(57) ABSTRACT

A small directional coupler includes a main line and a subline having a sufficient self-inductance value and achieving a very small insertion loss. A main-line conductor pattern and a subline conductor pattern are formed on the top surface of an insulating substrate by a method using photolithographic technologies. The main-line conductor pattern and the subline conductor pattern are formed in a spiral shape and so as to extend substantially parallel to each other. In order for the self-inductance value of the main line to be lower than the self-inductance value of the subline, the line width of the subline conductor pattern is narrower than the line width of the main-line conductor pattern. More specifically, it is preferable that the line width of the conductor pattern for a subline be about 50% to about 90% of the line width of the main-line conductor pattern.

20 Claims, 4 Drawing Sheets

DIRECTIONAL COUPLER

BACKGROUND OF THE INVENTION

1. Field of the Invention

The present invention relates to a directional coupler and, more particularly, to a directional coupler for use in a mobile communication device or other suitable electronic apparatus.

2. Description of the Related Art

Directional couplers in which two $\lambda/4$ lines are arranged in parallel on a ceramic substrate, and in which both ends of the respective lines (a main line and a subline) are connected to external electrodes, are known. However, as the size of the directional coupler becomes smaller, the pattern formation area of the ceramic substrate must become smaller. As a result, it becomes difficult to form two parallel linear lines in this reduced area. For this reason, mechanisms in which the lines have a meandering shape or a spiral shape and in which the lines are formed within a small pattern formation area have been adopted. In particular, a similar self-inductance value can be obtained with a spiral-shaped line having a shorter line length than with a linear line.

As a construction in which a main line and a subline are combined, there is what is commonly called a "side-edge-type construction" in which, as described above, a main line and a subline are arranged so as to be adjacent to each other on the same plane (the same layer). Alternatively, there is what is commonly called a "broadside-type construction" in which a main line and a subline are arranged with an insulating layer provided therebetween.

However, as the directional coupler becomes increasingly smaller, the pattern formation area is further reduced. Therefore, it becomes difficult to form a main line and a subline having the necessary self-inductance value within such a small area. In particular, when the subline cannot achieve a sufficient self-inductance value, a problem arises in that the isolation of the directional coupler becomes poor.

Furthermore, even if the line width of a main line and a subline is decreased simply to obtain the necessary self-inductance value, the resistance value of the line is caused to increase, resulting in an increase in the transmission loss of a signal. Since this causes an increase in the power consumption, this is a problem with regard to a mobile communication device, particularly, a battery-driven communication device, which problem cannot be ignored.

SUMMARY OF THE INVENTION

In order to overcome the problems described above, preferred embodiments of the present invention provide a small directional coupler in which a main line and a subline have a sufficient self-inductance value and in which insertion loss is very small.

According to a preferred embodiment of the present invention, a directional coupler includes a main line through which a high-frequency signal is transmitted, and a subline, provided on the same plane as the main line, which is electromagnetically coupled to the main line at a portion where the main line and the subline oppose each other, wherein the self-inductance value of the main line is smaller than the self-inductance value of the subline.

Here, as a construction in which the self-inductance value of the main line is lower than the self-inductance value of the subline, for example, the line width of the subline is narrower than that of the main line. More specifically, the line width of the subline is preferably about 50% to about 90% of the line width of the main line.

With the above-described unique construction, for the subline requiring a large self-inductance value, a large self-inductance value is secured by making the line width relatively narrow. In contrast, for the main line which does not require a large self-inductance value in comparison with the subline, the resistance value of the line can be minimized by making the line width relatively wide. At this time, by setting the electrode thickness of the main line to about 5 $\mu$m or more and by setting the ratio of the electrode thickness of the main line to that of the subline at about 2:1, the combined resistance value of the main line and the subline is decreased further, and transmission loss of a signal can be reduced.

Furthermore, as a result of multilayering the main line and the subline arranged on the same plane with an insulating layer provided therebetween and electrically connecting the main lines of each layer and the sublines of each layer in series through via holes provided in the insulating layers, respectively, a directional coupler of a multilayered structure can be obtained. For this directional coupler, since the line length of each of the main line and the subline can be lengthened, a higher degree of coupling can be obtained at high-frequency bands, and a sufficient degree of coupling can be obtained also at low-frequency bands.

According to another preferred embodiment of the present invention, a directional coupler includes a main line through which a high-frequency signal is transmitted, and a subline that is multilayered with the main line with an insulating layer provided therebetween, the subline being electromagnetically coupled to the main line along a portion where the main line and subline oppose each other, wherein the line width of the subline is narrower than the line width of the main line, and the self-inductance value of the main line is smaller than the self-inductance value of the subline.

Here, preferably, a grounding electrode opposes at least one of the lines of the main line and the subline with an insulating layer provided therebetween. As a result, a directional coupler of what is commonly called a "broadside-type construction" is obtained.

According to various preferred embodiments of the present invention, since the main line and the subline are electromagnetically coupled to each other along a portion where the main line and subline oppose each other on the same plane and since the self-inductance value of the main line is lower than the self-inductance value of the subline, a high degree of isolation is obtained, and insertion loss is greatly decreased. In particular, by setting the line width of the subline at about 50% to about 90% of the line width of the main line, a high degree of isolation is achieved also in the main line and the subline provided in a small pattern formation area, and characteristics can be improved without increasing the size of the directional coupler.

Furthermore, in the directional coupler of what is commonly called a "broadside-type construction", by setting the line width of the subline to be narrower than the line width of the main line and by decreasing the self-inductance value of the main line to be less than the self-inductance value of the subline, a small directional coupler in which a main line and a subline have a sufficient self-inductance value and insertion loss is small can be obtained.

Other features, elements, characteristics and advantages of the present invention will become more apparent from the following detailed description of preferred embodiments with reference to the attached drawings.

DETAILED DESCRIPTION OF PREFERRED EMBODIMENTS

A preferred embodiment of a directional coupler according to the present invention, along with the method of manufacturing the same, will be described below with reference to the attached drawings.

Figure 1:
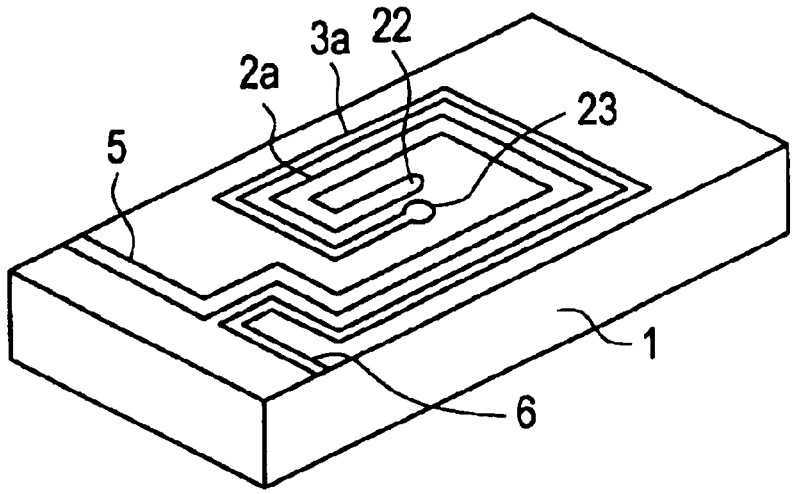
FIG. 1 is a perspective view showing a first preferred embodiment of a directional coupler according to the present invention.

As shown in FIG. 1, after the top surface of an insulating substrate 1 is polished so as to become a smooth surface, a main-line conductor pattern 2*a*, a subline conductor pattern 3*a*, and extension lines 5 and 6 are formed on the top surface of the insulating substrate 1 preferably by a thick-film printing method or a thin-film forming method such as sputtering, deposition, or other suitable process.

The thin-film forming method is, for example, a method described below. A conductive film having a relatively small film-thickness is formed on substantially the entire surface of the insulating substrate 1 by sputtering, deposition, or other suitable process, and, thereafter, a photoresist film (for example, a photosensitive resin film) is formed on substantially the entire surface of the conductor film by spin coating or printing. Next, a mask film having a predetermined image pattern formed thereon is coated on the top surface of the photoresist film, and the portion of a photoresist film desired is cured by the application of ultraviolet rays, or other suitable curing means. Next, after the photoresist film is peeled off leaving the cured portion, the conductive film of the exposed portion is removed by etching in order to form conductors (the main-line conductor pattern 2*a*, the subline conductor pattern 3*a*, etc.) having a desired pattern shape. Thereafter, the cured photoresist film is removed. In such a method using so-called photolithographic technologies, well-known methods, such as a wet etching method, a dry etching method, a lift-off method, an additive method, a semi-additive method, or other suitable method, are adopted where appropriate.

As another thin-film forming method, a method in which a photosensitive conductive paste is applied onto the top surface of the insulating substrate 1, after which a mask film having a predetermined image pattern formed thereon is coated, and is then exposed and developed, may also be used. In particular, when a photosensitive conductive paste is used, fine pattern processing becomes possible in a state in which the film thickness of the conductive film is thick, and in this particular preferred embodiment, losses can be minimized. Furthermore, since the spacing of lines can be made narrow, there is the advantage that a high degree of coupling between lines is obtained.

The thick-film printing method is a method in which, after, for example, a screen printing plate provided with an opening having a desired pattern shape is coated on the top surface of the insulating substrate 1, a conductive paste is applied from above the screen printing plate in order to form conductors (the main-line conductor pattern 2*a*, the subline conductor pattern 3*a*, etc.) having a desired pattern shape and a relatively large thickness on the top surface of the insulating substrate 1 exposed from the opening of the screen printing plate.

The main-line conductor pattern 2*a* and the subline conductor pattern 3*a* are preferably formed in a spiral shape in a state in which they extend substantially parallel (in other words, in the direction of the same winding). In order for the self-inductance value La of the main line 2 (to be described later) to become lower than the self-inductance value Lb of the subline 3, the line width of the subline conductor pattern 3*a* is narrower than the line width of the main-line conductor pattern 2*a*. More specifically, it is preferable that the line width of the subline conductor pattern 3*a* be about 50% to about 90% of the mainline conductor pattern 2*a*. As a result, a high degree of isolation can be obtained also in the main-line conductor pattern 2*a* and the subline conductor pattern 3*a*, provided in a small pattern formation area, allowing the pattern arrangement on the insulating substrate 1 to be optimized. As a result, it is possible to significantly improve the characteristics without increasing the size of the directional coupler.

Here, the self-inductance value when a directional coupler for use in the same frequency as that of the directional coupler of this first preferred embodiment is designed so that the line widths of the conductor patterns for the main line and for the subline are made substantially equal to each other as in the conventional case, and the self-inductance values of the main line and the subline become substantially equal to each other is denoted as Lo. With respect to this inductance value Lo, in this first preferred embodiment, the design is such that one of the following equations (1) and (2) is satisfied for the self-inductance value La of the main line 2 and the self-inductance value Lb of the subline 3:

$$La<Lb=Lo \quad (1)$$

$$La=Lo<Lb \quad (2)$$

In the case of equation (1), the line width of the subline conductor pattern 3*a* is substantially equal to the line width of the line conductor pattern of the conventional directional coupler, and the line width of the main-line conductor pattern 2*a* is thicker than the line width of the line conductor pattern of the conventional directional coupler. By contrast, in the case of equation (2), the line width of the main-line conductor pattern 2*a* is substantially equal to the line width of the line conductor pattern of the conventional directional coupler, and the line width of the subline conductor pattern 3*a* is thinner than the line width of the line conductor pattern of the conventional directional coupler.

Furthermore, in order to further increase the self-inductance value Lb of the subline 3, the subline conductor pattern 3*a* extends substantially parallel with, and outside of the main-line conductor pattern 2*a*.

Furthermore, in this first preferred embodiment, the electrode thickness of the main-line conductor pattern 2*a* is preferably about 5 $\mu$m or more, and the ratio of the electrode thickness of the main-line conductor pattern 2*a* to that of the subline conductor pattern 3*a* is preferably about 2:1. The reason for this is that the power of the high-frequency signal propagating through the main line 2 is larger than the power of the high-frequency signal propagating through the subline 3. As a result, the combined resistance value of the main line 2 and the subline 3 is decreased further, and the transmission loss of the signal can be reduced even more.

One end of the extension line 5 is connected to the main-line conductor pattern 2*a*, and the other end thereof is exposed on the side of the inner portion at the left end of the insulating substrate 1. One end of the extension line 6 is connected to the subline conductor pattern 3*a*, and the other end thereof is exposed on the side of the front side at the left end of the insulating substrate 1.

For materials of the insulating substrate 1, glass, glass ceramics, alumina, ferrite, Si, $SiO_2$, and other suitable materials, can be used. For materials of the mainline conductor pattern 2*a*, the subline conductor pattern 3*a*, and the extension lines 5 and 6, conductive materials, such as Ag, Ag—Pd, Cu, Ni, or Al, and other suitable materials, are preferably used.

Figure 2:
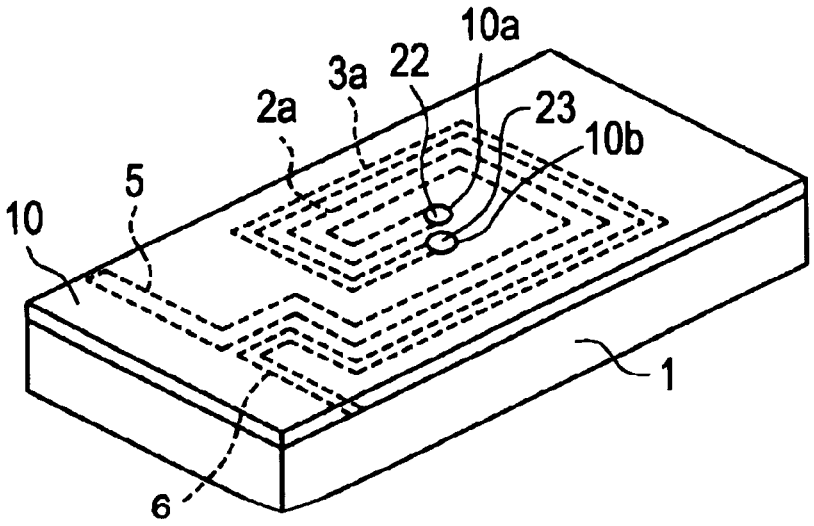
FIG. 2 is a perspective view showing a manufacturing procedure following FIG. 1.

Next, as shown in FIG. 2, an insulating layer 10 having openings 10*a* and 10*b* is formed. That is, an insulating material in a liquid state is applied onto the entire surface of the top surface of the insulating substrate 1 by spin coating, printing, or other suitable process, is dried, and is baked to form the insulating layer 10. For insulating materials, for example, a photosensitive polyimide resin, a photosensitive glass paste, or other suitable material, is preferably used. If a normal polyimide resin or a normal glass paste is used, in order to be processed into a desired pattern, it is necessary to form a resist layer and to process the resist layer. However, if a photosensitive polyimide resin or a photosensitive glass paste is used, since the photosensitive material applied to the entire surface of the substrate can be processed, the steps of resist application and resist peeling-off can be omitted, and efficient processing steps can be achieved.

Next, a mask film having a predetermined image pattern formed on the top surface of the insulating layer 10 is coated, and a desired portion of the insulating layer 10 is cured by, for example, the application of ultraviolet rays. Next, the uncured portion of the insulating layer 10 is removed to form openings 10*a* and 10*b*. In the opening 10*a*, a one-end portion 22 of the main-line conductor pattern 2*a* in a spiral shape is exposed. In the opening 10*b*, one-end portion 23 of the subline conductor pattern 3*a* having a spiral shape is exposed.

Figure 3:
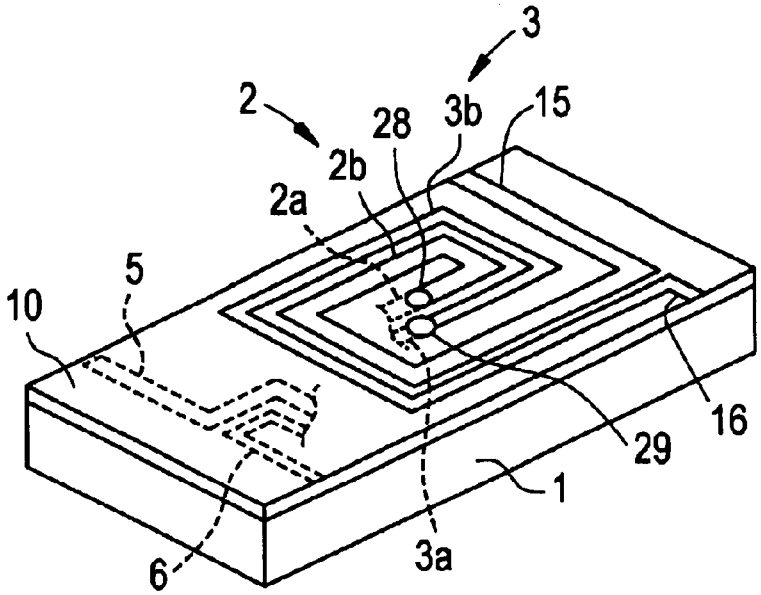
FIG. 3 is a perspective view showing a manufacturing procedure following FIG. 2.

Next, as shown in FIG. 3, a main-line conductor pattern 2*b*, a subline conductor pattern 3*b*, and extension lines 15 and 16 are formed by a thick-film printing method or by a thin-film forming method such as sputtering, deposition, or other suitable process, in a manner similar to a case where the main-line conductor pattern 2*a*, etc., is formed. The openings 10*a* and 10*b* of the insulating layer 10 are filled with a conductive material, thus forming via holes 28 and 29.

The main-line conductor pattern 2*b* is electrically connected in series to the end portion 22 of the main-line conductor pattern 2*a* through the via hole 28, forming the main line 2. The subline conductor pattern 3*b* is electrically connected in series to the end portion 23 of the subline conductor pattern 3*a* through the via hole 29, forming the subline 3. The main-line conductor patterns 2*a* and 2*b* substantially overlap each other in the thickness direction of the insulating layer 10, and the subline conductor patterns 3*a* and 3*b* substantially overlap each other in the thickness direction of the insulating layer 10. One end of the extension line 15 is connected to a main-line conductor pattern 2*b*, and the other end thereof is exposed on the side of the inner portion at the right end of the insulating substrate 1. One end of the extension line 16 is connected to a subline conductor pattern 3*b*, and the other end thereof is exposed on the side of the front side at the right end of the insulating substrate 1.

Figure 4:
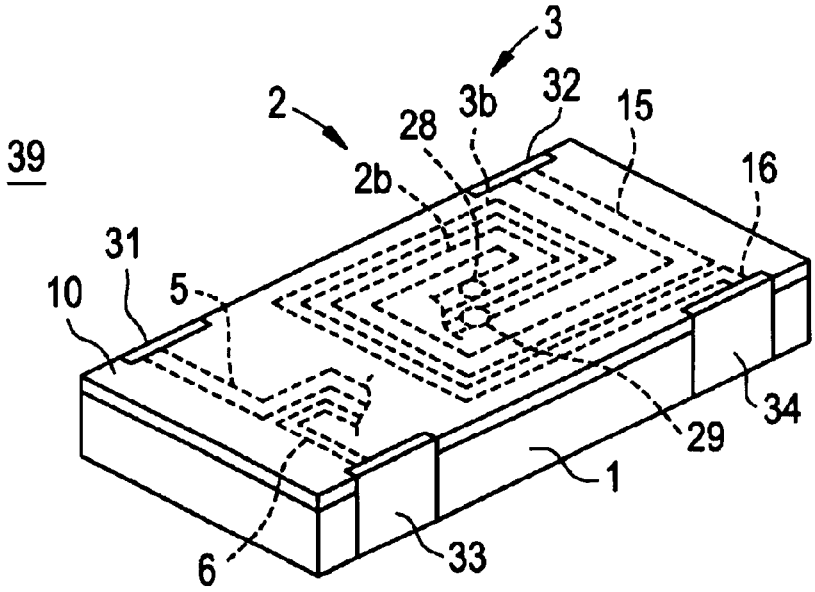
FIG. 4 is a perspective view showing a manufacturing procedure following FIG. 3.

Next, as shown in FIG. 4, an insulating material in a liquid state is applied onto the entire top surface of the insulating substrate 1 by spin coating, printing, or other suitable process, is dried, and is baked so as to be formed as the insulating layer 10 coated with the main-line conductor pattern 2*b*, the subline conductor pattern 3*b*, and the extension lines 15 and 16. Thereafter, a grounding electrode having a wide area is formed as necessary on the lower surface of the insulating substrate 1.

Next, input external electrodes 31 and 33, and output external electrodes 32 and 34 are provided on the side-surface portions of the inner portion and the front side of the insulating substrate 1, respectively. The input external electrode 31 is electrically connected to the extension line 5, and the output external electrode 32 is electrically connected to the extension line 15. Similarly, the input external electrode 33 is electrically connected to the extension line 6, and the output external electrode 34 is electrically connected to the extension line 16. For the external electrodes 31 to 34, after a conductive paste, such as, Ag, Ag—Pd, Cu, NiCr, NiCu, Ni, or other suitable material, is applied and is baked, a metallic film, such as Ni, Sn, Sn—Pb, or other suitable material, is formed by wet electrolytic plating, or by sputtering, deposition, or other suitable process.

A directional coupler 39 of a strip-line-type construction, obtained in this manner, is line-coupled electromagnetically in a portion where the main line 2 and the subline 3 oppose each other on the same plane. It is possible for the subline 3 to extract an output proportional to the power of the high-frequency signal propagating through the main line 2.

Figure 5:
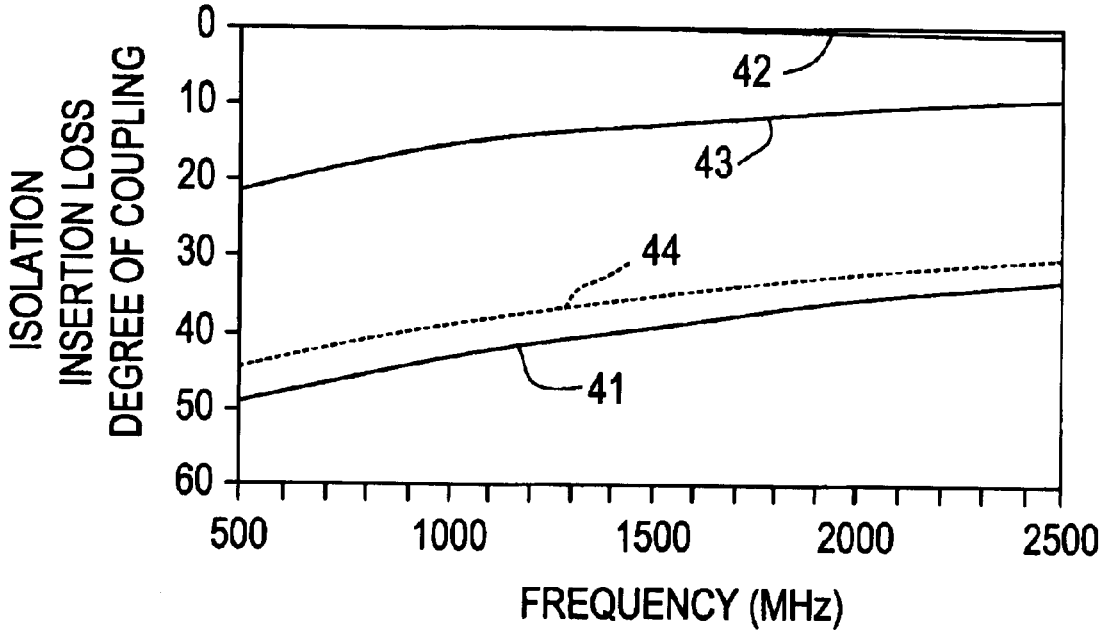
FIG. 5 is a graph showing isolation characteristics, insertion loss characteristics, and degree-of-coupling characteristics of a directional coupler shown in FIG. 4.

Then, the subline 3 requiring a large self-inductance value can obtain a large self-inductance value by making the line width reliably narrower. As a result, the directional coupler 39 having a high degree of isolation can be obtained. FIG. 5 shows isolation characteristics (see a solid line 41) of the directional coupler 39. In FIG. 5, the isolation characteristics (see a dotted line 44) of a conventional directional coupler are also described for comparison purposes. Then, for the main line 2 which does not require a large self-inductance value in comparison with the subline 3, the resistance value of the line can be minimized by making the line width relatively wider. Therefore, the insertion loss of the directional coupler 39 can be decreased (see the insertion loss characteristics shown by a solid line 42 in FIG. 5), and the power consumption of a battery-driven mobile communication device or other electronic apparatus, can be reduced.

Furthermore, since the directional coupler 39 does not have a construction in which a main line and a subline are arranged in different layers with an insulating layer provided therebetween, variations in characteristics resulting from misalignment which occurs between layers and resulting from variations in the thickness of interlayer insulating layers, etc., do not occur.

For the directional coupler 39 of this first preferred embodiment, the conductor pattern layers for the main line and the subline, arranged on the same plane, preferably include two layers. Of course, the conductor pattern layers may be one, three, or more layers as necessary. When the directional coupler 39 is formed into a multilayer structure having two or more layers, the line length of the main line 2 and the subline 3 can be increased, and a high degree of coupling between lines can be obtained at high-frequency bands, and a sufficient degree of coupling can be obtained also at low-frequency bands (see the degree-of-coupling characteristics indicated by a solid line 43 in FIG. 5).

Figure 6:
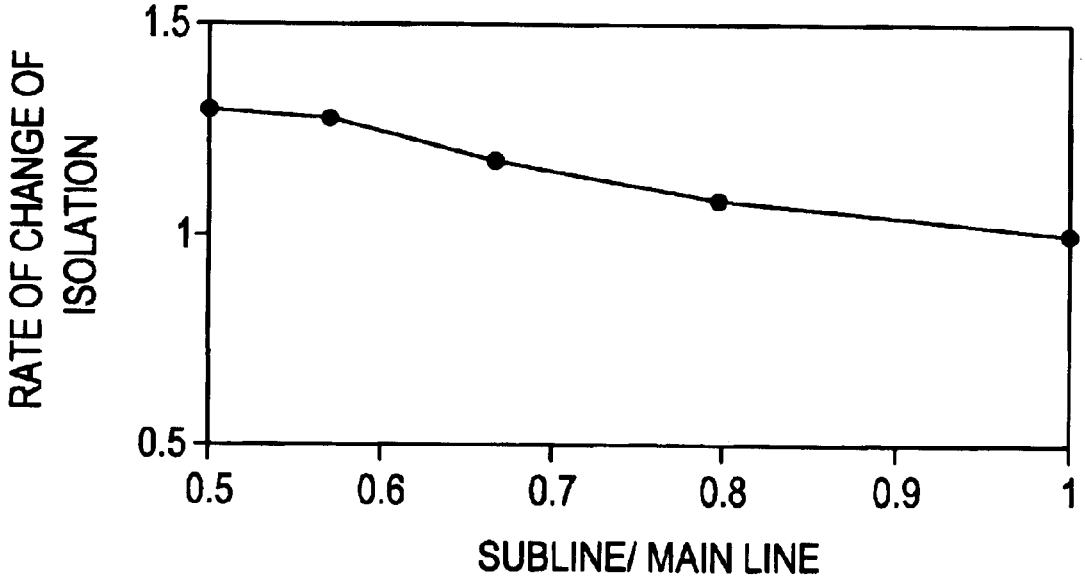
FIG. 6 is a graph showing the relationship between the ratio of a main line/subline and isolation.

FIG. 6 is a graph showing the relationship between the ratio of a main line/subline and isolation. It can be confirmed from FIG. 6 that, when the line width of the subline is about 90% or less of the line width of the main line, the effect of the improvement on the isolation characteristics is increased. The reason why it is preferable that the line width of the subline be about 50% or more of the line width of the of the main line is that, if the line width of the subline is made too narrow, the resistance value of the subline is increased, and the transmission loss of a signal cannot be ignored.

In a second preferred embodiment, a directional coupler of what is commonly called a broadside-type construction is described.

Figure 7:
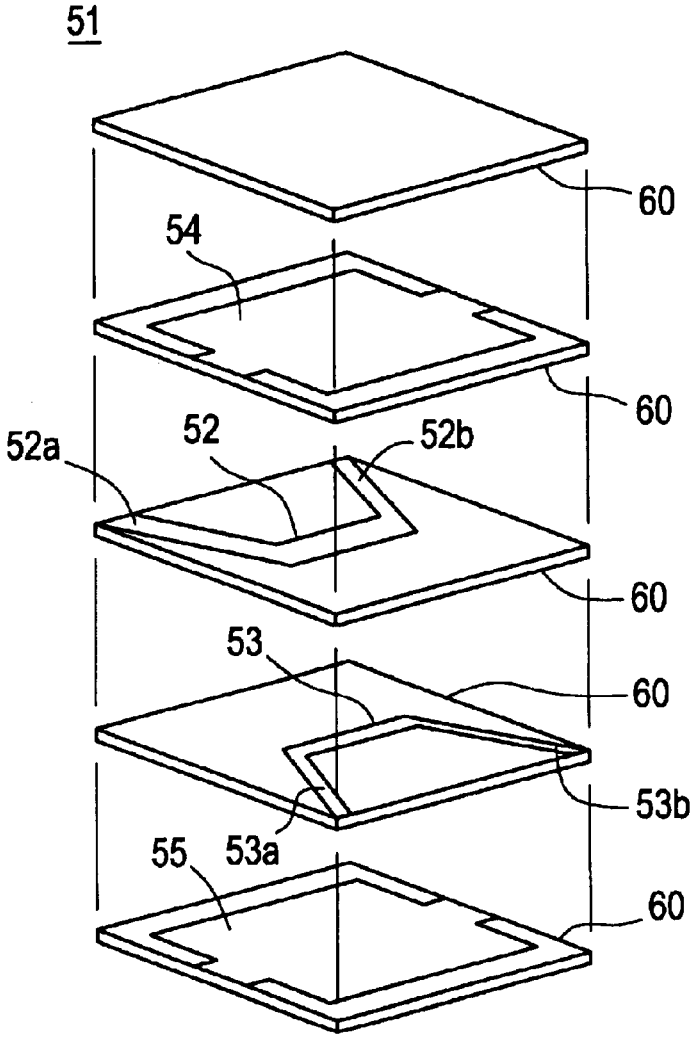
FIG. 7 is an exploded, perspective view showing the construction of a second preferred embodiment of a directional coupler according to the present invention.

As shown in FIG. 7, a directional coupler 51 is formed in such a way that insulating ceramic green sheets 60 having disposed on each of their surfaces a main line 52, a subline 53, and grounding electrodes 54 and 55, respectively, are multilayered with protective ceramic green sheets 60 being arranged on the top and on the bottom and are baked.

Both ends 52*a* and 52*b* of the main line 52 are exposed on the right and left of the side of the inner portion of the green sheet 60, respectively. Both ends 53*a* and 53*b* of the subline 53 are exposed on the right and left of the side of the front side of the green sheet 60, respectively. In order for the self-inductance value La of the main line 52 to be lower than the self-inductance value Lb of the subline 53, the line width of the subline 53 is narrower than the line width of the main line 52. More specifically, it is preferable that the line width of the subline 53 be about 50% to about 90% of the main line.

The main line 52 and the subline 53 are line-coupled electromagnetically in a linear portion where they oppose each other with a ceramic green sheet 60 provided therebetween. The grounding electrodes 54 and 55 are arranged above and below with the main line 52 and the subline 53 therebetween. The main line 52, subline 53, and other elements, are formed by a thin-film forming method (photolithographic method) such as sputtering, deposition, or other suitable process.

Figure 8:
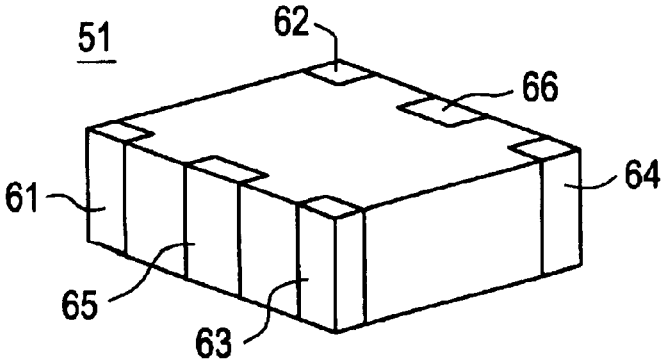
FIG. 8 is an external perspective view of the directional coupler shown in FIG. 7.

The green sheets 60 having the above-described construction are stacked and are integrally baked so as to define a laminate body. As shown in FIG. 8, in the end-surface portion of this laminate body, an input external electrode 61 and an output external electrode 62 of the main line 52, an input external electrode 63 and an output external electrode 64 of the subline 53, and external grounding electrodes 65 and 66 are provided. The input external electrode 61 and the output external electrode 62 are electrically connected to the end portions 52*a* and 52*b* of the main line 52, respectively. The input and output external electrodes 63 and 64 are electrically connected to the end portions 53*a* and 53*b* of the subline 53, respectively. The external grounding electrodes 65 and 66 are electrically connected to the grounding electrodes 54 and 55. This directional coupler 51 exhibits the same operational effects as those of the directional coupler 39 of the first preferred embodiment of the present invention.

The directional coupler of the present invention is not limited to the above-described preferred embodiments.

Although the above-described preferred embodiments describe the case of individual productions as an example, in the case of mass production, a method is effective in which a manufacture is made in the state of a mother substrate (wafer) having a plurality of directional couplers, and this is cut out for each individual product by a method, such as dicing, scribing and breaking, laser, or other suitable process, at the final step.

In addition, the directional coupler may be formed in such a way that a main line and a subline are directly formed on a printed board on which a circuit pattern is formed. Furthermore, the shape of the main line and the subline may be any shape, and in addition to the spiral shape and the linear shape of the above-described preferred embodiments, the shape may be a meandering shape.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A directional coupler comprising:

a main line through which a high-frequency signal is transmitted; and a subline provided on a common plane with said main line, the subline being electromagnetically coupled to said main line along a portion where said main line and said subline oppose each other, wherein a self-inductance value of said main line is smaller than a self-inductance value of said subline.

2. A directional coupler according to claim 1, further comprising a multilayered laminate body including insulating layers, wherein said main line and said subline are disposed on each layer of said multilayered laminated body with one of said insulating layers provided therebetween, and the main lines of each layer and the sublines of each layer are electrically connected to each other in series through via holes provided in said insulating layers.

3. A directional coupler according to claim 1, wherein a line width of said subline is narrower than a line width of said main line.

4. A directional coupler according to claim 1, wherein an electrode thickness of said main line is about 5 $\mu$m or more, and a ratio of the electrode thickness of said main line to that of said subline is about 2:1.

5. A directional coupler according to claim 1, wherein a line width of said subline is about 50% to about 90% of a line width of said main line.

6. A directional coupler according to claim 2, wherein said main line and said subline are made of a photosensitive conductive paste, and said insulating layers are made of a photosensitive glass paste.

7. A directional coupler according to claim 1, further comprising a substrate having an upper major surface, wherein said main line and said subline are disposed on said upper major surface of said substrate.

8. A directional coupler according to claim 7, wherein said substrate is made of at least one of glass, glass ceramics, alumina, ferrite, Si, and $SiO_2$.

9. A directional coupler according to claim 1, wherein the directional coupler is one of a strip-line type coupler and a broadside-type coupler.

10. A directional coupler according to claim 1, wherein the main line includes a main line conductor pattern and the subline includes a subline conductor pattern, and the subline conductor pattern extends substantially parallel with and outside of the main line conductor pattern.

11. A directional coupler comprising:

a main line through which a high-frequency signal is transmitted; and a subline that is electromagnetically coupled to said main line along a portion where the main line and the subline oppose each other, wherein a line width of said subline is narrower than a line width of said main line, and a self-inductance value of said main line is smaller than a self-inductance value of said subline.

12. A directional coupler according to claim 11, wherein a grounding electrode opposes at least one of said main line and said subline and an insulating layer is provided therebetween.

13. A directional coupler according to claim 12, wherein said main line and said subline are made of a photosensitive conductive paste, and said insulating layer is made of a photosensitive glass paste.

14. A directional coupler according to claim 11, further comprising a multilayered laminate body including insulating layers, wherein said main line and said subline are disposed on each layer of said multilayered laminated body with one of said insulating layers provided therebetween, and the main lines of each layer and the sublines of each layer are electrically connected to each other in series through via holes provided in said insulating layers.

15. A directional coupler according to claim 11, wherein an electrode thickness of said main line is about 5 $\mu$m or more, and a ratio of the electrode thickness of said main line to that of said subline is about 2:1.

16. A directional coupler according to claim 11, wherein a line width of said subline is about 50% to about 90% of a line width of said main line.

17. A directional coupler according to claim 11, further comprising a substrate having an upper major surface, wherein said main line and said subline are disposed on said upper major surface of said substrate.

18. A directional coupler according to claim 17, wherein said substrate is made of at least one of glass, glass ceramics, alumina, ferrite, Si, and $SiO_2$.

19. A directional coupler according to claim 11, wherein the directional coupler is one of a strip-line type coupler and a broadside-type coupler.

20. A directional coupler according to claim 11, wherein the main line includes a main line conductor pattern and the subline includes a subline conductor pattern, and the subline conductor pattern extends substantially parallel with and outside of the main line conductor pattern.

* * * * *